US005199124A

United States Patent [19]

Klemis

[11] Patent Number: 5,199,124

[45] Date of Patent: Apr. 6, 1993

[54] CUSHION TO PREVENT SLEEPING ON THE ABDOMEN

[76] Inventor: Daniel E. Klemis, 25 Hale St., Beverly, Mass. 01915

[21] Appl. No.: 895,948

[22] Filed: Jun. 9, 1992

[51] Int. Cl.[5] ..... A47C 20/00; A47G 9/00; A61G 7/06

[52] U.S. Cl. ..... 5/630; 5/632; 5/652; 128/846

[58] Field of Search ..... 5/630, 648, 632, 652; 128/871, 846

[56] References Cited

U.S. PATENT DOCUMENTS

| | | | |
|---|---|---|---|
| 1,668,489 | 5/1928 | Brand | 5/630 |
| 2,521,530 | 9/1950 | McGuffage | 5/630 X |
| 4,969,222 | 11/1990 | Serola | 5/630 |
| 4,989,591 | 2/1991 | Anders, Jr. | 5/630 X |
| 5,048,542 | 9/1991 | Murray | 128/846 X |

FOREIGN PATENT DOCUMENTS

| | | |
|---|---|---|
| 1239709 | 7/1988 | Canada . |
| 1449012 | 6/1966 | France . |
| 1590583 | 6/1981 | United Kingdom . |

*Primary Examiner*—Michael F. Trettel

[57] ABSTRACT

A device to prevent a user from sleeping on or rolling onto the abdomen during sleeping including a resilient foam cushion having a generally wedge-shaped cross-section. The cushion is formed with a base having length and a width sufficient to engage major portions of the user's abdomen and sternum. The cushion further has two converging sides extending from the base, the elevation of the sides being between about 0.5 and 1.5 times the width of the base. A belt is used to maintain the cushion in position on the user's abdomen and sternum during sleeping. The belt extends from the cushion and is arranged to engage the torso of the user.

8 Claims, 1 Drawing Sheet

CUSHION TO PREVENT SLEEPING ON THE ABDOMEN

BACKGROUND OF THE INVENTION

The present invention relates to a wedged or semi-ovoidal foam cushion that can be attached to the body to prevent a user from rolling onto the abdomen while sleeping. In particular, the present invention relates to a wedged or semi-ovoidal foam cushion which attaches to the anterior thorax in the region of the sternum and abdomen. A belt extends from the cushion or can be wrapped around it and also around the torso whereby to enable the cushion to maintain its position on the abdomen and sternum.

It is well known that sleeping on the abdomen promotes postural strain to the cervical spine and gives poor postural support to the lower back. Sleeping on the abdomen may also aggravate or promote certain neck or back conditions. The preferred posture for sleeping is on the back or the side. For those individuals who have a habit of sleeping on their abdomen it is often difficult to maintain a side or back position while sleeping. The natural tendency of these individuals is to roll onto the abdomen.

In accordance with the present invention, I have discovered that a wedged or semi-ovoidal shaped foam cushion that is attached to the abdomen can prevent the user from rolling onto the abdomen while sleeping. The cushion of the present invention prevents the user from rolling onto the abdomen and supports the user when the user is sleeping on the. If the user turns from side to side, the belt that holds the cushion keeps it in its position on the anterior thorax and prevents stomach sleeping even if movement occurs.

It is especially important that the device of the present invention enables the user to continue sleeping even when sleeping on one side or the other. Promoting continuous sleep is extremely important because users should not be awakened by position-controlling equipment.

In the past, a more common way of controlling sleep positions was to place a tennis ball against the anterior thorax in the area of the solar plexus and secure them with a wrap-around elastic band. In this way, when the user rolled onto the stomach, the ball would press against the solar plexus and awaken the user. Continual awakening for a person who has a habit of sleeping on the stomach is highly undesirable and should be avoided.

Many types of cushions have been disclosed to the art. The Crew U.S. Pat. No. 4,796,315, discloses a belt attached to a contoured cushion to hold the cushion in place and provide support to the spine in its naturally curved position while lying in a supine position. A portable seating device is disclosed by Martin, U.S. Pat. No. 4,934,005, in which a belt is used to enable the user to be seated with the buttocks on the ground with the legs bent at the knees. A padded back support is disposed against the upper region of the user's back when worn. The French patent to Emelien, 1.449.012, discloses a pair of contoured cushions which are disposed on each side of an infant and secured in place with a belt to prevent the infant from rolling. A support cushion is disclosed in Canadian patent 1,239,709 to change the position of the pelvis of a person lying in a supine position so that the lumbar spine flattens and the mechanical stresses and symptoms of lower back pain are eliminated. The Serola U.S. Pat. No. 4,969,222, discloses a cushion for supporting the chest and shoulders of a patient while lying in a prone position.

SUMMARY OF THE INVENTION

According to the present invention I have discovered a device to prevent the user from rolling onto the abdomen during sleep. The device is a resilient foam cushion having a generally wedge-shaped cross-section with a base that has a length and width sufficient to engage major portions of the user's abdomen and sternum. The cushion has two converging sides extending upwardly from the base to provide a generally triangular, trapezoidal or semi-ovoidal cross-section. A belt is cooperatively associated with the cushion so that the user can wrap it around the torso and secure the cushion in place on the anterior thorax.

BRIEF DESCRIPTION OF THE DRAWINGS

In FIG. 2 a generally trapezoidally shaped device is shown and in FIG. 3 the cushion is semi-ovoidal.

In FIG. 4 the person using the device is lying on his back. In FIG. 5 the person has shifted to the side and the cushion is engaging the bed on which the person is lying.

DESCRIPTION OF THE PREFERRED EMBODIMENTS

The invention relates to a device which is designed to prevent an individual from rolling onto the abdomen while sleeping since sleeping on the abdomen promotes postural strain to the cervical spine and gives postural support to the lower back which can aggravate or promote certain neck or back conditions. According to the invention a cushion is designed to be belted onto a user and held in place to cover the anterior thorax in the region of the sternum and abdomen. An adjustable belt or belt is associated with the cushion and is adapted to encircle the torso to hold cushion in place and maintain its position on the anterior thorax while the user is sleeping. The cushion is designed to have a generally wedged-shaped cross-section so that the user can roll onto either side while sleeping and without causing sufficient discomfort for awakening. Continual use of the cushion for a prolonged time can eliminate the user's habit of sleeping on the abdomen.

Figure 1:
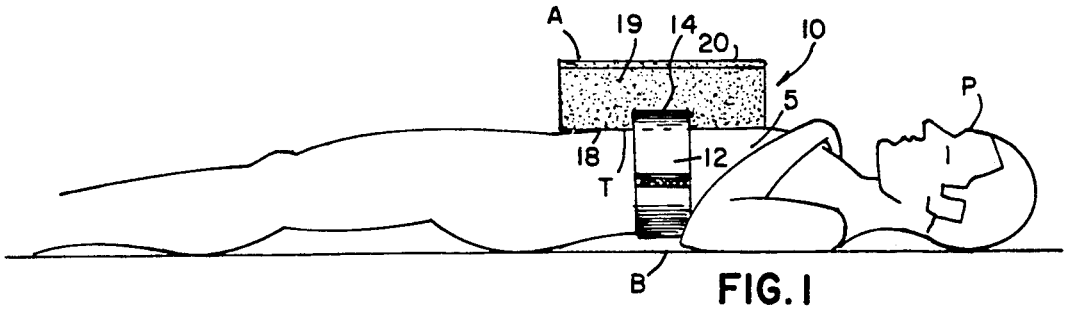
FIG. 1 is a side elevational view of the device of the present invention belted upon the torso of a person who is disposed in a supine position.

Referring now to FIG. 1 of the drawings, a person P is shown in a supine position on a bed B. The cushion 10 is shown disposed on the anterior thorax T of the user and covers substantially all of the abdomen A and the sternum S. A base 18 of the cushion 10 includes a planar base surface having a sufficient lateral extent that it provides a stable base surface for disposition on the anterior thorax T so that portions of the cushion will not roll on to themselves as the user rolls during sleeping.

In many cases the length of the cushion 10 should be modified depending upon the sex of the user. Shorter cushions should be used for women to avoid covering the breasts although it is important to cover most of the area between the sternum to the abdomen. Men can use longer cushions whereby all of the sternum can be covered.

Preferably the width of the cushion can be between about 7 and 10 inches and length can be between about 10 and 16 inches. Preferably, the width is about 8 inches. For women the length is about 12 inches and for men the length is about 14 inches. Since the objective of the present invention is to provide a mechanism to prevent rolling onto the user's abdomen during sleep, both dimensions are significant parameters to achieve a stable support to prevent the cushion from moving during use and to prevent the cushion from doubling over on itself if the user rolls on it.

Figure 2:
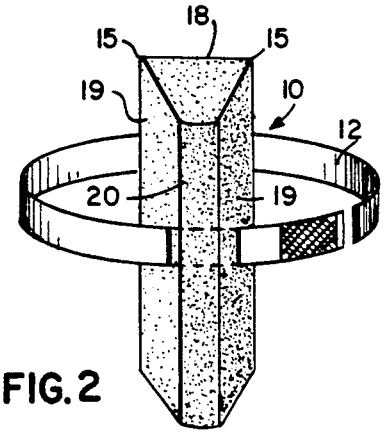
FIGS. 2 and 3 are alternate embodiments of the device of the present invention.

Regarding the height of the cushion, I have found that the included angles 15 formed between the base 18 and the sides 19 should be between about 30 and 80° which provides for a wedge-shaped cushion with an elevation between about 4 and 6 inches. With the trapezoidal-shaped embodiment shown in FIG. 2, the apex of the cushion 10 preferably is about 5 inches from the base 18. The width of the top 20 can be about 2½ inches when the included angles are 60°. The flat top 20 of the trapezoid shape is desirable because it eliminates inordinately big cushions while still providing the wedging action that is needed to prevent abdominal sleeping.

Figure 3:
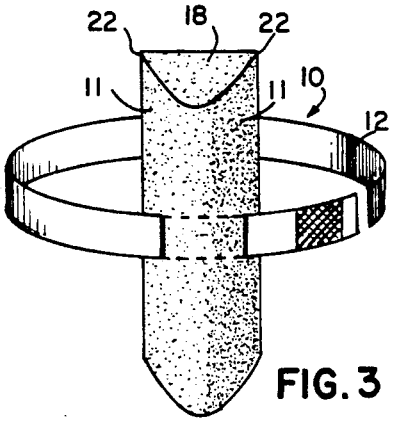

In FIG. 3 the cushion has a semi-ovoidal shape with a base 18 again being between about 6 and 10 inches with the preferred width being 8 inches. Again, the elevation of the cushion 10 can be between 4 and 6 inches with the preferred height being 5 inches. The included angles 22 formed between the base 18 and the sides 11 of the semi-ovoidal shaped cushion 10 are preferably 70°. The semi-ovoidal cross-section provides side walls 11 which are rotationally contoured from the base 18 to intersect each other and form the semi-ovoidal shape. The ovoidal shape with its rounded contours frequently is easier for a user to wear and may be simpler to manufacturer.

Figure 4:
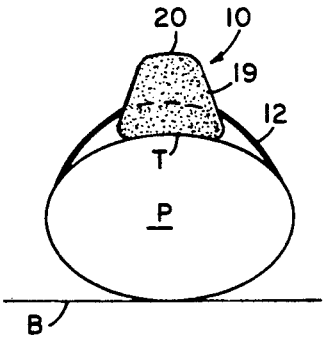
FIGS. 4 and 5 are schematic views of the device belted onto a torso.
Figure 5:
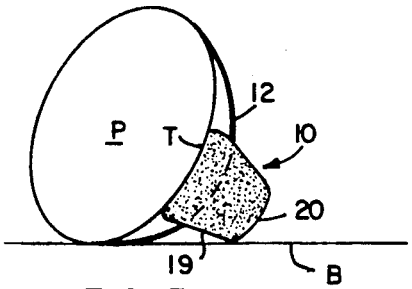

Referring to FIGS. 4 and 5, a schematic end view is presented of a person P lying supine on a bed B. The cushion 10 is disposed upon the anterior thorax T and held in place in that location by belt 12. In the drawing, a side 19 of the cushion 10 engages bed B and prevents further rolling over. Such engagement enables the wearer to sleep on one side or the other but prevents sleeping on the abdomen.

In the embodiments shown in the drawings, a belt 12 is threaded through an aperture 14 in the cushion 10. In another embodiments, the belt 12 can be placed over the apex 20 of the cushion 10 in which case there would be no attachment of the belt 12 to the cushion 10. In another embodiment the cushion can be covered in a suitable fabric and belt 12 that can be sewn to the portion of the fabric which covers the base 18.

The entire cushion 10 is preferably constructed from a block of treatable polyurethane foam which is washable and preferably fire resistant. The foam material is resilient yet firm enough to prevent the user from rolling over on it. In the preferred embodiment the cushion 10 may be machine washable, as is the belt 12.

With regard to the belt 12 any comfortable material can be used preferably, the material is washable and is made of a fabric. Suitable mechanisms for joining the ends of belt 12 together so as to provide for a snug fit can include snaps or conventional hook and loop fabrics such as Velcro.

It can thus be seen that the advantageous construction of the present invention can prevent abdominal sleeping when the cushion is securely belted over the anterior thorax in the region of the sternum and abdomen. The cushion enables the user to sleep on either side or on the back but will prevent complete rolling over onto the abdomen as the person changes positions during sleep. The device will not waken the user and does not inhibit normal sleeping.

While a preferred embodiment of the invention has been described using specific terms such description is for illustrative purposes only and it is to be understood that changes and variations may be made without departing from the spirit or scope of the following claims.

As my invention I claim.

1. A device to prevent a user from sleeping on or rolling onto the abdomen during sleeping, said device comprising:

a resilient cushion having a generally wedge-shaped cross-section, said cushion being characterized as having a generally rectangular resilient base and a length and a width sufficient to engage major portions of the user's abdomen and sternum, the length of said cushion being greater then its width, said cushion further being characterized as having two sides extending from said base and converging into an apex, said apex being disposed parallel to said length, the elevation of said sides being between about 0.5 and 1.5 times the width of said base;

fastening means to secure said cushion and maintain said resilient base in position on the user's abdomen and sternum during sleeping with said apex being parallel to the long axis of the user, said fastening means extending transversely of said apex of said cushion and engaging and wrapping around the torso of the user.

2. The device according to claim 1 wherein the angles between the base and the sides is between about 30 and 80°.

3. The device according to claim 1 wherein the cushion is made of resilient foam.

4. The device according to claim 1 wherein the cushion is covered in fabric.

5. The device according to claim 1 wherein the cushion has a generally trapezoidal cross-section and each of the angles between the base and the sides is between 50 and 60°.

6. The device according to claim 1 wherein the cushion has a semi-ovoidal cross-section and said side walls are rotationally contoured from the base to intersect each other and form the semi-ovoidal shape.

7. The device according to claim 1 wherein the fastening means is a belt of sufficient length to engage said cushion, wrap around the user's torso and provide attachment with opposite ends whereby to secure said cushion to the user.

8. The device according to claim 1 wherein the length of the cushion is between about 10 and 16 inches and the width is between about 7 and 10 inches and the elevation is between about 4 and 6 inches.

* * * * *